United States Patent [19]

Soulas et al.

[11] 3,937,913

[45] Feb. 10, 1976

[54] SEALED PUSH-BUTTON CONTROL APPARATUS

[75] Inventors: Jacques Soulas, St-Remy-Les-Cheureuse; Paul Vilella, Chilly Mazarin, both of France

[73] Assignee: Compagnie Industrielle des Telecommunications Cit-Alcatel, France

[22] Filed: Dec. 18, 1973

[21] Appl. No.: 425,786

[30] Foreign Application Priority Data

Dec. 18, 1972 France ..... 72.45034

[52] U.S. Cl...... 200/302; 200/159 R; 200/340

[51] Int. Cl.[2]..... H01H 3/12; H01H 9/04

[58] Field of Search..... 200/296, 340, 159 R, 314, 200/302, 293

[56] References Cited

UNITED STATES PATENTS

| | | | |
|---|---|---|---|
| 2,284,813 | 6/1942 | Gary | 200/328 X |
| 2,568,933 | 9/1951 | Robbins | 200/296 X |
| 2,984,726 | 5/1961 | Roeser | 200/296 X |
| 3,255,333 | 6/1966 | Schuchard | 200/340 X |
| 3,305,660 | 2/1967 | Sohns et al. | 200/330 |

*Primary Examiner*—James R. Scott
*Assistant Examiner*—William J. Smith
*Attorney, Agent, or Firm*—Craig & Antonelli

[57] ABSTRACT

Setting off device protected against atmospheric conditions by a recessed configuration inside a box applicable to any sort of equipment installed out-of-doors, more particularly, to telephone posts.

4 Claims, 3 Drawing Figures

SEALED PUSH-BUTTON CONTROL APPARATUS

The invention comes within the branch of connection elements. It concerns a setting-off device protected against atmospheric conditions. It applies to all sorts of equipment installed out-of-doors, more particularly, to telephonic posts on motorways.

All along great highway routes and more particularly along motorways, there are telephonic posts intended for making a call to a supervisory authority in the case of breakdown or accident.

It is a current practice to set off the telephonic equipment contained in such a post by pressing a push-button which is large and strong, whose head projects on the outside of the post. Such buttons are currently named "punches."

Absolutely certain operation in all weather may rightfully be expected of such equipment. Now, if the telephonic equipment placed inside the post is suitably protected, it may happen, in conditions which will be specified herebelow, that the operation of the outdoor push-button may be impeded by snow or ground frost. Indeed, in known "punch" push-buttons, the stroke of the push-button is ensured from a position of the push-button head projecting from the front face of the post. The result of this is that if snow or ground frost accumulate between the head of the push-button and the front face of the post, cramming occurs — the push-button no longer responds to the manipulations of the user.

To avoid this disadvantage, the invention provides for the placing of the push-button head flush with the front face, manipulation being effected in a recessed position with respect to the said face toward the inside and not from the outside towards the face.

The invention will be described in detail with reference to the accompanying drawings, among which:

Figure 1:
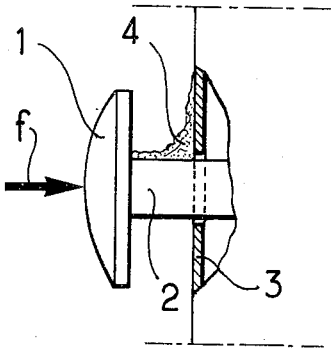
FIG. 1 PRIOR ART
FIG. 1 shows, in a simplified form, the front part of the known push-button.

FIG. 1 shows a push-button head 1, intended for actuating a device (not shown) by means of a rod 2. The head is placed before the front face 3 of an equipment cupboard, for example, an outdoor telephone post, more particularly, a motorway telephone post. The setting-off maneuver for the equipment is effected by pressing the head 1 of the press-button towards the front face 3 in the direction of an arrow f.

If an accumulation of ground frost such as shown at 4 has occurred under the effect of the pushing, there is cramming and jamming. It is impossible to set off the telephonic equipment.

Figure 2:
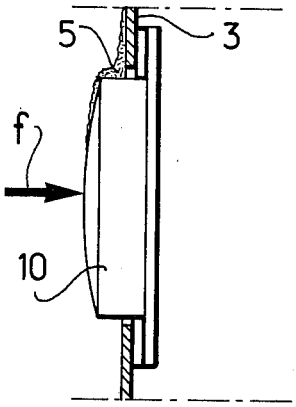
FIG. 2 shows the front part of a push-button according to the invention.

FIG. 2 shows the push-button according to the invention having a head 10 which comes flush with the front face 3. In these conditions, if there is ground frost, it forms a virtually plane layer 5, which is broken without difficulty by the effort necessary for manipulating the press-button head in the direction of the arrow f. There is no danger of jamming the mechanism with the ground frost. The substance used for manufacturing the head 10 is a "polystyrene shock" material having a perfectly smooth surface condition, on which the ice has a very slight coefficient of adherence.

Figure 3:
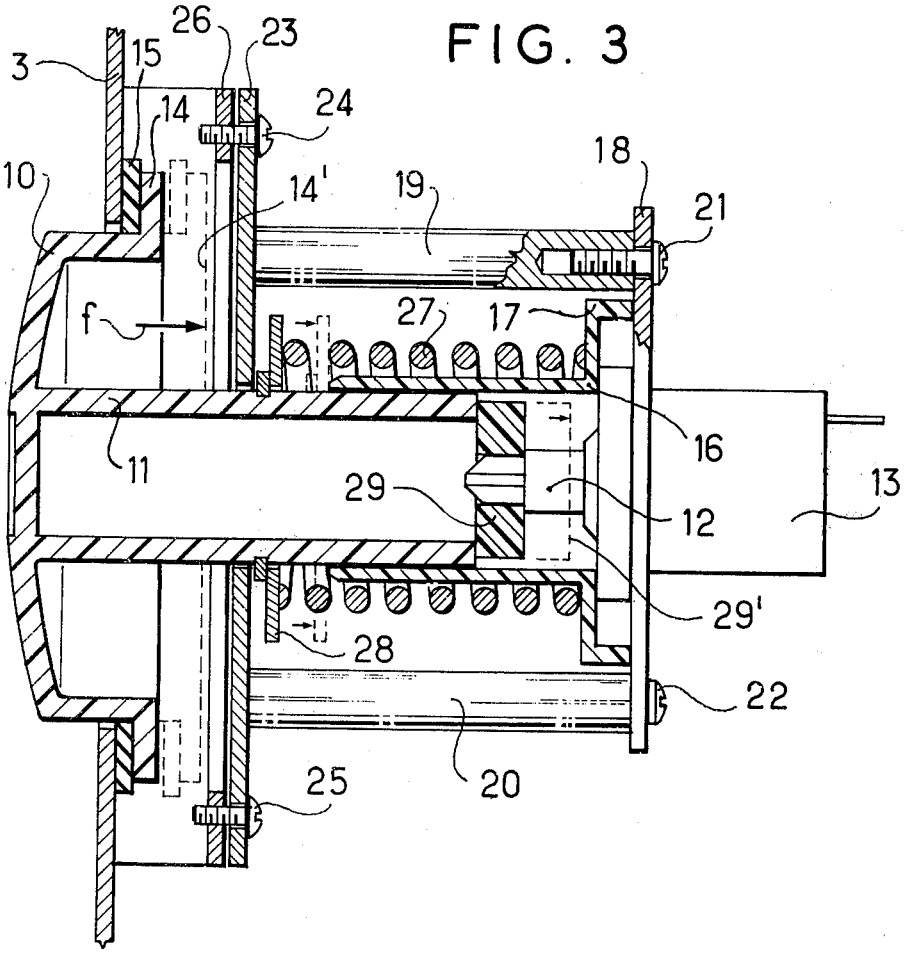
FIG. 3 shows a cut-away view, on a larger scale, of an example of embodiment of a "punch" push-button according to the invention.

In FIG. 3 the push-button head 10 forms a single part with a hollow cylindrical part 11 which bears, at its back, a short rod 12 which is able to transmit to an element 13, for example, a switch, a control movement. The push-button head 10 bears, at the back part, an edge 14 which, in the rest position, bears against the internal side of the front face 3 through a seal ring 15, for example, a rubber washer.

The hollow cylinder 11 is kept in another hollow cylinder 16 which bears, by a back part in the form of a washer 17, on a metallic plate 18. The plate 18 is held by tow rods 19, 20, clamped by screws 21, 22 onto a plate 23, itself held by screws 24, 25, against the back part of a clevis 26 welded onto the internal side of the front face 3.

The plate 18 prevents the free ingress of dampness into the equipment placed behind it and therefore fulfills a sealing function.

A coil spring 27 bearing against, on the one hand, a washer 28 fast with the hollow cylinder 11, on the other hand, a 17 cylindrical part of the cylinder 16 ensures the rest position of the push-button by the pressing of the edge 14 against the front face 3 through the seal 15. Under the effect of a push in the direction of the arrow f, a setting off control is transmitted to the element 13 through a short rod 12 fast with the bottom 29 of the hollow cylinder 11.

The position of the edge 14 (14') and of the bottom 29 (29') in the pushing position in the direction of the arrow f has been shown by discontinuous lines.

What is claimed is:

1. A push-button apparatus for actuating out-door equipment disposed within an equipment housing, comprising a push-button having a cap-shaped part protruding through a hole in the equipment housing from inside toward the outside thereof and a cylindrical part projecting from the central portion of the inside surface of said cap-shaped part, the inside of said equipment housing including a hollow cylindrical member fixed with respect to said equipment housing and positioned to slideably engage said cylindrical part of said push-button, a collar fixed to the cylindrical part of said push-button and a spring disposed between said collar and said hollow cylindrical member for biasing said push-button in a direction toward the outside of said equipment housing, wherein said hollow cylindrical member is fixed with respect to said equipment housing by means including a clevis secured to said housing, a plate contacting said hollow cylindrical member and a plurality of rod-shaped supports secured between said plate and said clevis.

2. A push-button apparatus as defined in claim 1 wherein a seal ring is disposed between a rim of said cap-shaped part of said push-button and said equipment housing.

3. A push-button apparatus as defined in claim 2 wherein a switch having an actuating member is supported with the actuating member contacting said cylindrical part of said push-button.

4. A push-button control apparatus as defined in claim 1 wherein said equipment is fixed behind a plate which performs a sealing function, the control movement of said equipment being transmitted by a rod fixed on said cylindrical part of said push-button.

* * * * *